US006153968A

United States Patent [19]

Dombrowski et al.

[11] Patent Number: 6,153,968

[45] Date of Patent: Nov. 28, 2000

[54] METAL HALIDE LAMP WITH STEM MOUNTED SUPPORT FRAME FOR ARC TUBE SHIELD

[75] Inventors: Kevin S. Dombrowski, Painted Post, N.Y.; Kevin D. Provagna, Medina; James M. Gensert, Litchfield, both of Ohio

[73] Assignee: Philips Electronics North America Corp., New York, N.Y.

[21] Appl. No.: 09/165,681

[22] Filed: Oct. 2, 1998

[51] Int. Cl.[7] ..... H01J 19/12

[52] U.S. Cl. ..... 313/238; 313/25

[58] Field of Search ..... 313/238, 25, 242, 313/292

[56] References Cited

U.S. PATENT DOCUMENTS

| | | | |
|---|---|---|---|
| 4,401,913 | 8/1983 | Koza et al. | 313/25 |
| 5,023,505 | 6/1991 | Ratliff et al. | 313/25 |
| 5,079,480 | 1/1992 | Canale et al. | 315/47 |
| 5,339,001 | 8/1994 | King et al. | 313/25 |
| 5,532,543 | 7/1996 | Van Der Leeuw et al. | 313/25 |
| 5,998,915 | 12/1999 | Scholz et al. | 313/234 |

FOREIGN PATENT DOCUMENTS

| | | | |
|---|---|---|---|
| 0186899 | 7/1986 | European Pat. Off. | H01J 61/34 |

*Primary Examiner*—Vip Patel
*Attorney, Agent, or Firm*—F. Brice Faller

[57] ABSTRACT

A protective sleeve of quartz surrounding a metal halide arc tube is fixed to upright portions of a frame by means of retaining rings. The frame has lower ends formed with coils fitted over the glass stem in an interference fit, thereby insulating the frame from the electrical leads sealed in the stem. An intermediate portion of the frame fits closely in the opposite end of the lamp to stabilize the burner assembly and shield.

11 Claims, 3 Drawing Sheets

METAL HALIDE LAMP WITH STEM MOUNTED SUPPORT FRAME FOR ARC TUBE SHIELD

BACKGROUND OF THE INVENTION

The invention relates to a lamp, in particular a metal halide discharge lamp, having a protective shield around the light source, wherein the shield is supported by a metal frame mounted to the stem, and a glass envelope fixed to the stem surrounds the shield.

Metal halide lamps typically incorporate a tubular shield surrounding the pressurized arc tube to absorb the impact of dispersing shards in the event the arc tube fractures. This shield is supported by a metal frame mounted to the stem in the lamp. For low to medium wattage lamps the frame is typically in two parts embedded in the stem, and these parts also serve to provide current for the electrodes of the arc tube. See, for example, U.S. Pat. No. 5,532,543.

Since current-carrying members in proximity to the arc tube can cause sodium loss, it is preferable to electrically distance the current carriers from the lateral walls of the arc tube. Note the insulating sleeve on the frame member in U.S. Pat. No. 5,532,543. See also U.S. Pat. No. 5,339,001. While this patent does not show a protective shield, it does show a frame member which supplies only the lower electrode of the arc tube, and a "flying lead" well spaced from the arc tube to supply the upper electrode.

Safety considerations in high wattage metal halide lamps dictate that a protective sleeve be used. However in order to adequately support such a protective sleeve and at the same time prevent sodium loss, it is desirable for the supporting frame to be electrically isolated from the current carriers for the arc tube. Mounting techniques used by OSI and GE for their high wattage protected metal halide lamps incorporate a U-shaped wire frame having metal bands welded to the ends thereof, the bands being welded in place around the glass stem. This allows the frame to be electrically isolated (floating), which is especially desirable for high wattage protected lamps. However the multiple welding steps add to the cost of manufacture, and would preferably be eliminated.

SUMMARY OF THE INVENTION

According to the invention the metal frame includes a wire frame member having a first end formed with a first coil having at least one loop, the coil being fixed around the stem to position the protective sleeve (shield) with respect to the shield. In a preferred embodiment the wire frame member has a second end formed with a second coil having at least one loop, the second coil being fixed around the stem in tandem with the first coil.

The coils on the ends of the frame are forced over the stem in an interference fit, and are sufficiently resilient to accommodate variations in the diameter of the stem. In a preferred embodiment, each of the coils is formed with a pair of end portions which cross over and extend beyond the coil, so that pinching the end portions together enlarges the diameter of the coil to facilitate fitting onto the stem.

The frame is formed with upright portions which support the protective sleeve around the arc tube, which may also be supported by the frame. Between the uprights the frame is formed with an intermediate portion which engages the inside of the lamp envelope to stabilize the position of the frame, the arc tube, and the shield.

The principles of the invention are not limited to a support frame formed by a single wire having a coil at each end, but may be used in a frame having only one frame member with a coil fitted to the stem, or two separate frame members with coils fitted to the stem.

DETAILED DESCRIPTION OF THE PREFERRED EMBODIMENT

Figure 1:
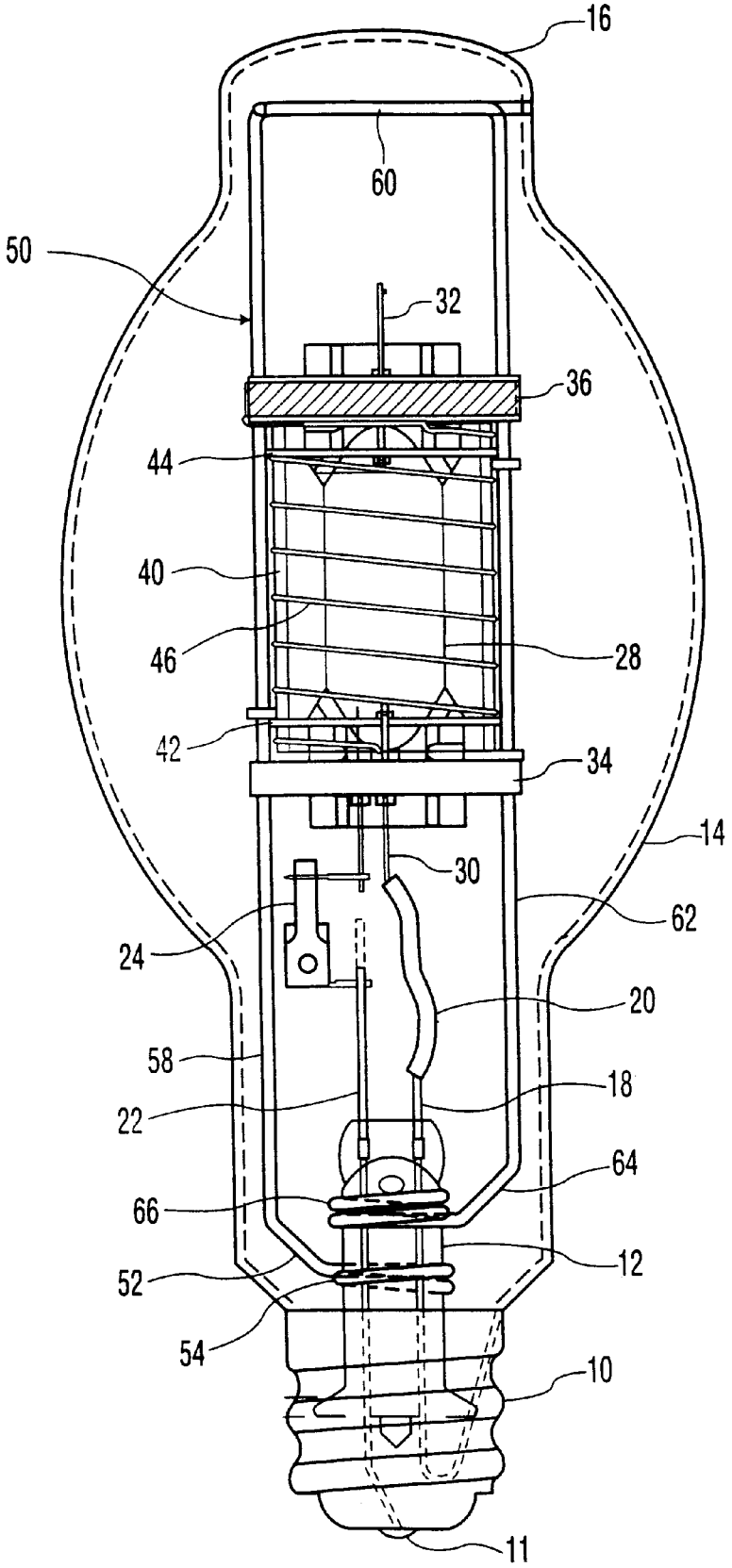
FIG. 1 is an elevation view of a lamp with a shield supported by a frame according to the invention.
Figure 2:
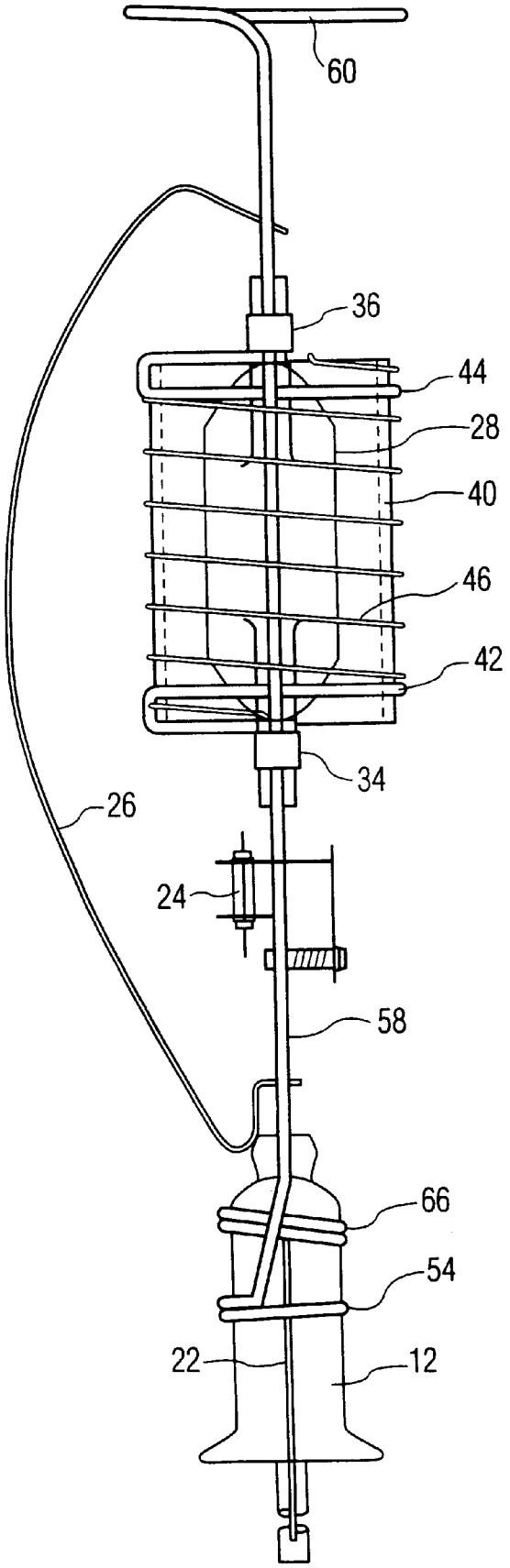
FIG. 2 is an elevation view of the shield and frame mounted to the stem, as seen orthogonally to the view of FIG. 1.

FIG. 1 shows a complete metal halide discharge lamp including a screw base 10 with an insulated center contact 11, a glass stem 12, and a glass envelope 14 sealed to the stem. Inside the lamp is an arc tube 28 with pinched ends supported by straps 34, 36 fixed to frame 50. A first lead 18 and a second lead 22 are received through the stem 12 and connected to respective lead-throughs 30, 32 in opposite ends of the arc tube. These serve as electrodes for maintaining an arc. The first lead 18 is connected to the first lead-through 30 via braided connection 20, while the second lead 22 is connected to the second lead-through 32 via a flying lead 26 (FIG. 2). Before the lead 26 carries current, a starter 24 causes a glow discharge at the first end, whereupon a bimetal strip in the starter 24 opens to shunt current through lead 26 to the second electrode. Starting circuits are described in some detail in U.S. Pat. No. 5,079,480.

Figure 3:
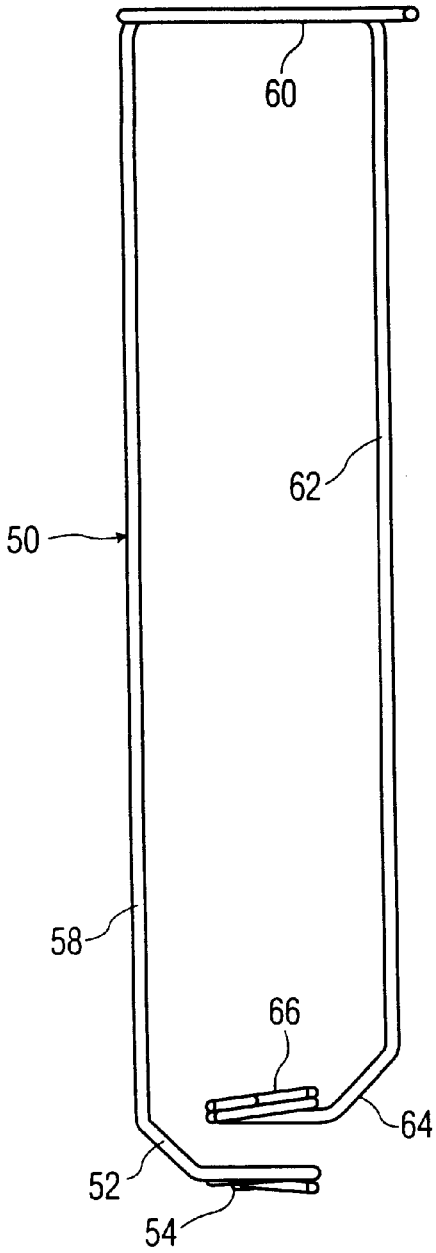
FIG. 3 is an elevation view of the frame.
Figure 4:
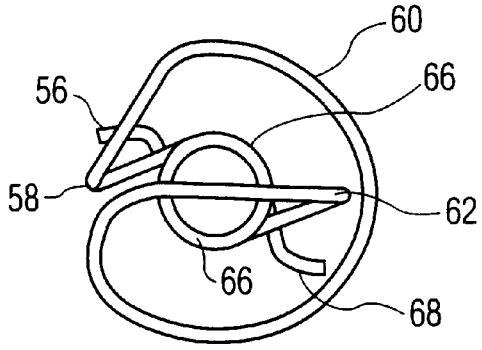
FIG. 4 is a plan view of the frame.

Referring also to FIGS. 2–4, the frame 50 has a first end 52 provided with a first coil 54, a first upright 58, an intermediate portion 60, a second upright 62, and a second end 64. Each strap 34, 36 is welded to a respective upright 62, 58 and supports the arc tube 28 somewhat as shown in U.S. Pat. No. 5,339,001.

A quartz sleeve or shield 40 surrounding the arc tube 28 is held in place by a lower retaining ring 42 and an upper retaining ring 44; these are welded to respective uprights 62, 58 with respective straps 34, 36. The quartz sleeve 40 absorbs the impact of flying shards of arc tube in the event of non-passive failure. A wire helix 46 surrounding the sleeve 40 limits radial dispersion of any quartz fragments in the event the sleeve 40 fractures, thus further protecting the glass envelope 14 in the event of arc tube failure. Between the uprights 58, 62 is an intermediate portion 60 formed as a loop received in remote end 16 of the glass envelope with sufficient tolerance to stabilize the frame, arc tube assembly, and shield with respect to the envelope. Stabilization may also be achieved by a loop received around an internal dimple of the type shown in U.S. Pat. No. 5,339,001.

Referring to FIG. 3, the frame 50 is formed from 0.0801" diameter stainless steel wire. Each coil 54, 66 is precision formed to have an internal diameter only slightly smaller than the outside of the glass stem 12, in order to effect an interference fit. As shown in FIG. 4, each coil 54, 56 may be formed with a tail 56, 68 which crosses over the respective end 52, 54 on the opposite side of the coil, thus forming a pair of end portions for each coil which cross over each other. Squeezing the end portions of a coil together opens up the coil to facilitate placement on the stem 12. Otherwise placement is accomplished by a force fit to expand the coils. The tolerances are very close, but within the purview of modern wire forming machines.

Manufacture of the lamp unit is accomplished by first forming the stem 12 with leads 18, 22 therein, assembling the various components including the arc tube 28 and protective sleeve 40 to the frame 50, fitting the frame coils 54, 56 onto the stem, and completing the electrical connections. The glass envelope 14 is then sealed to the stem 12 and the screw base 10 and contact 11 are fitted in known fashion.

The foregoing is exemplary and not intended to limit the scope of the claims which follow.

What is claimed is:

1. A lamp comprising a light source, a glass stem, a pair of leads embedded in said stem for supplying electrical current to said light source, a protective sleeve surrounding said light source, a glass envelope surrounding said sleeve and fixed to said stem, and a metal frame supporting said sleeve, said metal frame comprising a wire frame member comprising a first end formed with a first coil comprising at least one loop, said coil being fixed around said stem to position said sleeve in said envelope.

2. A lamp as in claim 1 wherein said wire frame member further comprises a second end formed with a second coil comprising at least one loop, said second coil being fixed around said stem in tandem with said first coil to position said sleeve in said envelope.

3. A lamp as in claim 2 wherein said coils are sufficiently resilient to be received on said stem in an interference fit.

4. A lamp as in claim 3 wherein each of said coils is formed with a pair of end portions which cross over each other and extend beyond the coil so that pinching said end portions together enlarges the diameter of the coil, whereby fitting of the coils to the stem is facilitated and variations in diameter of the stem are accommodated.

5. A lamp as in claim 2 wherein said wire frame member is formed with a first upright portion adjacent said first end and a second upright portion adjacent said second end, at least one of said upright portions supporting said protective sleeve.

6. A lamp as in claim 5 further comprising an intermediate portion intermediate said upright portions, said intermediate portion engaging said lamp envelope to stabilize the position of the metal frame and the sleeve with respect to said envelope.

7. A lamp as in claim 1 wherein said coil is sufficiently resilient to be received on said stem in an interference fit.

8. A lamp as in claim 7 wherein said coil is formed with a pair of end portions which cross over each other and extend beyond the coil so that pinching said end portions together enlarges the diameter of the coil, whereby fitting the coil to the stem is facilitated and variations in diameter of the stem are accommodated.

9. A lamp as in claim 1 wherein said wire frame member comprises a first upright portion adjacent said first end, said first upright portion supporting said protective sleeve.

10. A lamp as in claim 9 wherein said first upright portion extends to an envelope engaging portion where said wire frame member is formed to engage said envelope and thereby stabilize the position of the protective sleeve with respect to said envelope.

11. A lamp as in claim 10 wherein said wire frame member is a first wire frame member, said metal frame further comprising a second wire frame member comprising a second coil having at least one loop, said second coil being fixed around said stem in tandem with said first coil to position said sleeve in said envelope.

* * * * *